US007956491B2

(12) United States Patent
Ochi et al.

(10) Patent No.: US 7,956,491 B2
(45) Date of Patent: Jun. 7, 2011

(54) INTEGRATED MULTI-TRANSFORMER

(75) Inventors: Sam Seiichiro Ochi, Saratoga, CA (US); Ernest Henry Wittenbreder, Jr., Flagstaff, AZ (US)

(73) Assignee: ASIC Advantage Inc., Sunnyvale, CA (US)

( * ) Notice: Subject to any disclaimer, the term of this patent is extended or adjusted under 35 U.S.C. 154(b) by 42 days.

(21) Appl. No.: 12/404,971

(22) Filed: Mar. 16, 2009

(65) Prior Publication Data

US 2009/0230776 A1 Sep. 17, 2009

Related U.S. Application Data

(60) Provisional application No. 61/037,078, filed on Mar. 17, 2008.

(51) Int. Cl.
*H01F 3/00* (2006.01)
*H01F 27/00* (2006.01)

(52) U.S. Cl. ..... 307/17

(58) Field of Classification Search ..... 307/17
See application file for complete search history.

(56) References Cited

U.S. PATENT DOCUMENTS 6,281,779 B1 * 8/2001 Matsumoto et al. ..... 336/200
6,380,836 B2 * 4/2002 Matsumoto et al. ..... 336/200
6,795,282 B2 9/2004 Neumuller et al.
6,980,077 B1 * 12/2005 Chandrasekaran et al. .. 336/212
7,016,203 B2 * 3/2006 Xu et al. ..... 363/21.04
7,034,647 B2 4/2006 Yan et al.
2002/0057584 A1 * 5/2002 Brockmann ..... 363/98
2009/0219124 A1 * 9/2009 Young ..... 336/65

FOREIGN PATENT DOCUMENTS

JP 61-32506 A 2/1986
JP 01-293606 A 11/1989
JP 07-023526 A 1/1995
JP 12-195732 A 7/2000

OTHER PUBLICATIONS

International Search Report, International Application No. PCT/US2009/037422, dated Mar. 17, 2009.

* cited by examiner

*Primary Examiner* — Jared J Fureman
*Assistant Examiner* — Adi Amrany
(74) *Attorney, Agent, or Firm* — Holland & Hart LLP

(57) ABSTRACT

Methods, systems, and devices are described for integrating multiple transformers on a shared core, while avoiding interference between the transformers and other potentially undesirable effects of the integration. In one embodiment, multiple transformers are wound on a shared core. Each transformer is wound on the core, so that its primary and secondary windings are magnetically coupled to each other through the core without being coupled to the windings of other transformers sharing the core. The multiple integrated transformers may then be provided in a circuit arrangement by placing only a single core element in the arrangement.

21 Claims, 12 Drawing Sheets

INTEGRATED MULTI-TRANSFORMER

CROSS-REFERENCE

This application claims priority from co-pending U.S. Provisional Patent Application No. 61/037,078, filed Mar. 17, 2008, entitled "INTEGRATED MULTI-TRANSFORMER", which is hereby incorporated by reference, as if set forth in full in this document, for all purposes.

BACKGROUND

The present invention relates to transformers in general and, in particular, to multiple integrated transformers.

Many electronic applications use multiple transformers, often for different purposes. For example, electronic systems often use power transformers to convert power coming from an external power supply (e.g., a battery or line voltage from a wall outlet) into power compatible with the electronic components in the application. Many of these systems also use pulse transformers to transfer signals from one side of an isolation boundary to another (e.g., for feedback or control purposes).

Typically, two separate transformers may be provided, each with its own core. These two transformers may then be independently placed in a package (e.g., in the housing of the electronics) and may be physically separated and uncoupled from one another. Multiple cores, multiple placements, separation requirements, and other factors may create a number of issues. For example, the design and production of these electronic systems may be more costly, complex, and failure-prone than if there were only a single placement of an integrated device.

As such, it may be desirable to integrate multiple transformers on a single core, while avoiding interference and other undesirable effects of integration.

SUMMARY

Among other things, embodiments of the invention provide for integrating multiple transformers on a shared core, while mitigating interference and other undesirable effects of the integration. In one embodiment, multiple transformers are wound on a shared core. Each transformer is wound on the core, so that its primary and secondary windings are magnetically coupled to each other through the core without being coupled to the windings of other transformers sharing the core. The multiple integrated transformers may then be provided in a circuit arrangement by placing only a single core element in the arrangement.

In one set of embodiments, an integrated multi-transformer is provided. The multi-transformer includes a core made of magnetic material and a plurality of transformers magnetically coupled with the core. The plurality of transformers includes a first transformer having a first primary winding and a first secondary winding, the first primary winding being configured to receive a first primary current and to couple the first primary current to the core to generate a first core flux, and the first secondary winding being configured so that at least a portion of the first core flux is coupled from the core to induce a first secondary current in the first secondary winding; and a second transformer having a second primary winding and a second secondary winding, the second primary winding being configured to receive a second primary current and to couple the second primary current to the core to generate a second core flux, and the second secondary winding being configured so that at least a portion of the second core flux is coupled from the core to induce a second secondary current in the second secondary winding. The transformers are wound so that first core flux induces substantially no current in the second transformer and the second core flux induces substantially no current in the first transformer.

In certain embodiments, the core is an "E" core, having a first leg, a second leg, and a third leg, wherein the first leg and the third leg have substantially equivalent cross-sectional areas. The first primary winding is wound on the first leg and the third leg; the first secondary winding is wound on the first leg and the third leg; and the second primary winding and the second secondary winding are wound on the second leg. In some embodiments, the second leg has substantially double the cross-sectional area of the first leg. In other embodiment, the core comprises a number of legs, the number of legs being one greater than the number of transformers coupled with the core. In some embodiments, one of the transformers is a power transformer and the other is a pulse transformer. In other embodiments, the transformers are selected from the group consisting of: a power transformer, a pulse transformers, a signal transformer, and a current sense transformer. Also, in some embodiments, the second transformer is wound substantially orthogonally with respect to the first transformer.

In some embodiments, the multi-transformer further includes a third transformer wound on the core substantially orthogonally with respect to at least one of the first transformer or the second transformer. In certain on these embodiments, the first transformer is wound substantially orthogonally with respect to the second transformer; and the plurality of transformers further includes a third transformer wound on the core substantially orthogonally with respect to both the first transformer or the second transformer.

In some embodiments, at least a portion of the core is circular and one of the transformers is formed toroidally around the core. In other embodiments, the multi-transformer further includes packaging configured to be placed in a circuit arrangement and to house at least a portion of the core and the plurality of transformers magnetically coupled with the core. The packaging may be further configured to provide at least partial physical, electrical, or electromagnetic isolation. The packaging may also have a plurality of interface regions, including: a first interface region coupled with the first primary winding; a second interface region coupled with the first secondary winding; a third interface region coupled with the second primary winding; and a fourth interface region coupled with the second secondary winding. The packaging may additionally or alternatively include a core interface region coupled with the core.

In another set of embodiment, a system is provided for handling multiple signals using an integrated multi-transformer. The system includes a first signal generation module configured to generate a first generated signal; a second signal generation module configured to generate a second generated signal; a first signal utilization module configured to utilize a first transformed signal; a second signal utilization module configured to utilize a second transformed signal; and a multi-transformer, comprising core, a first transformer, and a second transformer, the first transformer being wound on the core and configured to generate a first magnetic flux in the core, and the second transformer being wound on the core and configured to generate a second magnetic flux in the core, the second magnetic flux being decoupled from the first magnetic flux, wherein the first transformer is configured to receive the first generated signal from the first signal generation module, generate the first transformed signal as a function of the first generated signal, and communicate the first transformed signal with the first signal utilization module, and wherein the second transformer is configured to receive the second generated signal from the second signal generation module, generate the second transformed signal as a function of the second generated signal, and communicate the second transformed signal with the second signal utilization module.

In yet another set of embodiments, a method for producing an integrated multi-transformer device is provided. The method includes winding a first transformer on a core made of a magnetic material, the first transformer having a first primary winding and a first secondary winding, the first primary winding being configured to receive a first primary current and to couple the first primary current to the core to generate a first core flux, and the first secondary winding being configured so that at least a portion of the first core flux is coupled from the core to induce a first secondary current in the first secondary winding; and winding a second transformer on the core, the second transformer having a second primary winding and a second secondary winding, the second primary winding being configured to receive a second primary current and to couple the second primary current to the core to generate a second core flux, and the second secondary winding being configured so that at least a portion of the second core flux is coupled from the core to induce a second secondary current in the second secondary winding. The second transformer is wound on the core so that the first core flux induces substantially no current in the second secondary winding and the second core flux induces substantially no current in the first secondary winding.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a second label that distinguishes among the similar components (e.g., a lower-case character). If only the first reference label is used in the specification, the description is applicable to any one of the similar components having the same first reference label irrespective of the second reference label.

DETAILED DESCRIPTION OF EMBODIMENTS

Systems, devices, and methods are described for integrating multiple transformers on a single core.

Figure 1:
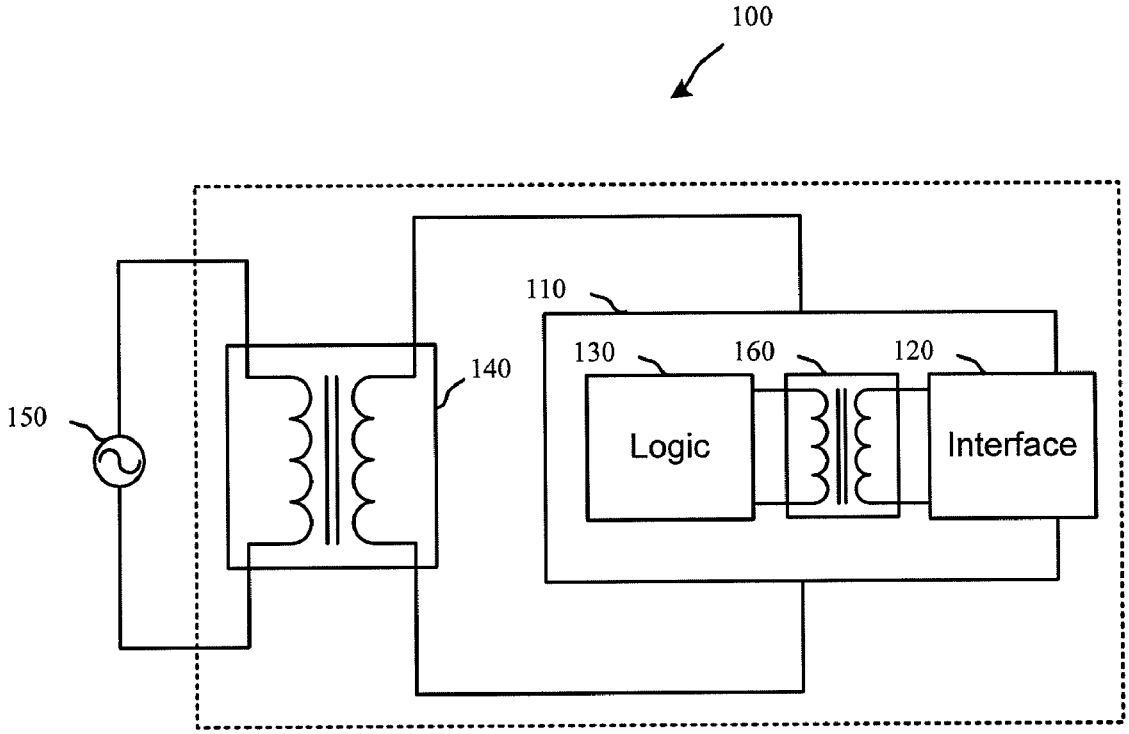
FIG. 1 shows a simplified circuit diagram of illustrative applications using two transformers.

Many electronic systems use multiple transformers for different purposes. An example of such a system is a powered electronic sensor circuit. FIG. 1 shows a simplified circuit diagram of illustrative applications using two transformers. The circuit 100 is powered by an external power source 150 (e.g., standard 110-volt alternating current ("AC"), 60 Hertz, mains line voltage), and has a number of application components 110, including interface components 120 for interfacing with a secondary system and logic components 130 for interpreting the data received by the interface components 120.

One embodiment is described as an illustrative powered electronic sensor circuit 100. The powered electronic sensor circuit 100 has a number of sensing components 110. The sensing components 110 include a sensor 120 for sensing an external stimulus and converting the stimulus into a digital pulse signal, and logic 130 for interpreting the digital pulse signal.

It may be desirable to isolate the sensing components 110 from the power source 150. For example, the sensing components 110 may be designed to operate at a particular voltage, different from the input voltage supplied by the power source 150, and to be isolated from input voltage artifacts (e.g., ground loops, interference, etc.). As such, a power transformer 140 may be provided at the input side of the powered electronic sensor circuit 100. The line voltage input from the power source 150 may be connected to the primary side of the power transformer 140, and the sensing components 110 may be connected to the secondary side of the power transformer 140. The power transformer 140 may then transform the input voltage to be compatible with the sensing components 110, while providing an isolation boundary between the sensing components 110 and the power source 150 (e.g., and/or ground).

Additionally, it may be desirable to isolate the sensing components 110 from each other. For example, for the sensing components 110 to operate properly, the sensor 120 and the external environment being sensed may have to be isolated from the internal logic 130. As such, a second transformer, e.g., a pulse transformer 160, may be provided between the sensor 120 and the logic 130. The pulse transformer 160 may isolate the logic 130 from the external environment, while allowing desired pulse information from the sensor 120 to cross the isolation boundary for interpretation by the logic 130.

Another embodiment is described as an illustrative high-side switch circuit 100. A high-side switch circuit 100 may be designed to connect or disconnect the power source 150 (e.g., a battery) to or from a load, based on an external control signal. The control signal may be received by interface components 120, and passed to logic components 130 operable to use the control signal to connect or disconnect power to or from a load. For example, a high-side switch may be used in battery-powered consumer electronics where certain voltage and current controls are desired (e.g., a feature-rich mobile phone).

The high-side switch circuit 100 may use the power transformer 140 to isolate and/or convert power from the power source 150 to a bus voltage. At the same time, the high-side switch circuit 100 may use the pulse transformer 160 to isolate the interface components 120 from the logic components 130 (and thereby from the load). In this way, both the control signal input voltage may be isolated from other components of the electronic system, from each other, and/or from the load.

Typically, the power transformer 140 and the pulse transformer 160 may each be manufactured on its own core. This may allow the transformers to be physically separated and otherwise isolated, so they may operate without interfering with one another. However, using two separate transformers on two cores may also increase the cost and complexity of the powered electronic sensor circuit. For example, the physical separation may necessitate a larger housing for the electronics, multiple cores may require increased material costs, multiple transformer placements may require more assembly complexity and time, etc.

Integrating the two transformers onto a single core, however, may yield desirable results, including reductions in cost, cycle time, size, complexity, failure rates, etc. A difficulty with integrating multiple transformers onto a single core, however, may be the maintenance of isolation between the transformers. If the transformers are allowed to interfere with one another, they may not operate properly.

Embodiments of the invention integrate multiple transformers on a single core, while maintaining isolation between the transformers. It will be appreciated that, while both of the application examples described above use two transformers, a power and a pulse transformer, many other numbers and types of transformers may be integrated according to various embodiments. For example, other types of transformers are known in the art, including current sense transformers, gate drive transformers, isolation transformers, audio transformers, etc. As such, while embodiments are described herein with reference to specific numbers and types of transformers, these descriptions are intended to be illustrative only and should not be construed as limiting the scope of the invention. Further, as used herein, the term "transformer" may include any electromagnetic circuit element that is usable in the context of embodiments of the invention.

Figure 2:
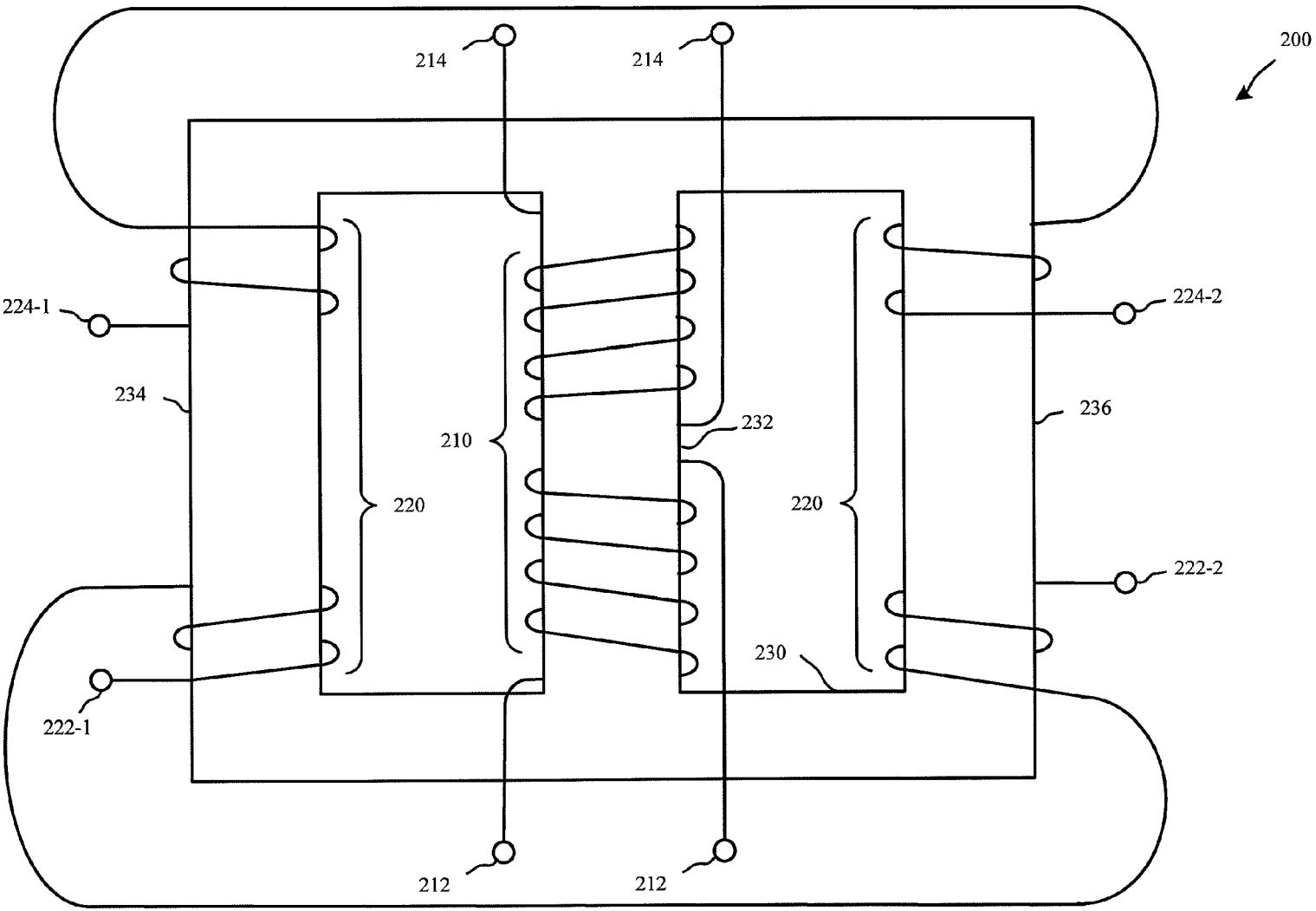
FIG. 2 illustrates an exemplary integrated multi-transformer, according to embodiments of the invention.

FIG. 2 illustrates an exemplary integrated multi-transformer, according to embodiments of the invention. The integrated multi-transformer 200 includes a power transformer 210 with a primary winding 212 and a secondary winding 214, and a pulse transformer 220 with a primary winding 222 and a secondary winding 224. The power transformer 210 and the pulse transformer 220 are integrated on a single core 230, such that the transformers are decoupled and other impacts of one transformer on the other are minimized.

In some embodiments, the power transformer 210 and the pulse transformer 220 are integrated on a three-leg "E" core 230. It will be appreciated that many other core shapes are possible, and that references specifically to an "E" core are intended only to provide clarity of description, and not to limit the scope of the embodiments. Further, it will be appreciated that a single core may actually be manufactured from a number of component parts. For example, an "E" core may be manufactured by coupling (e.g., gluing) two "E"-shaped cores together (e.g., facing each other) or by coupling one "E"-shaped core with an "I"-shaped core.

Various embodiments provide different types of power transformers 210 and pulse transformers 220. In certain embodiments, the power transformer 210 is a flyback transformer. The power transformer 210 is formed on the center post 232 of the core 230, by winding the primary winding 212 and the secondary winding 214 of the power transformer 210 around the center post 232 of the core 230. While the power transformer 210 may be wound in different ways, it may be desirable to maximize the efficiency of the power transformer 210 (e.g., while it may be relatively less important in many applications to maximize the efficiency of the pulse transformer 220). As such, it may be desirable to wind the power transformer 210 on the center post 232, as illustrated, to minimize the distance between the primary winding 212 and the secondary winding 214 of the power transformer 210, thereby reducing losses in flux transfer between the windings.

In some embodiments, the pulse transformer 220 is a small-signal pulse transformer. The small-signal pulse transformer may process near zero energy, making its effect on core losses and saturation substantially negligible. In various embodiments, forming a small-signal pulse transformer may allow transmission of timing information across a high voltage isolation boundary with high common mode immunity. The timing information may be used for circuit control and feedback functions. Further, in certain embodiments, multiple signals are transmitted across the isolation boundary using one or more modulation mechanisms with a single pulse transformer 220.

One advantage of using a small-signal pulse transformer as the pulse transformer 220 may be that a small number of turns can be used to transmit timing information across an isolation boundary so that the impact of windings on the available window area of the core 230 is a minimum. Only enough turns may be required to reliably transmit and receive the timing information contained in a pulse. For many magnetic circuit elements, only a single primary turn and a single secondary turn may be required, but for very small magnetic elements more than one or a few turns may be required.

The pulse transformer 220 is formed on the outer legs (234 and 236) of the core 230. The primary winding 222 and the secondary winding 224 of the pulse transformer 220 are wound on the outer legs (234 and 236), by winding one pair of windings (one from the primary winding 222-1 and one from the secondary winding 224-1) to the left outer leg 234, and winding a substantially identical pair of windings (again, one from the primary winding 222-2 and one from the secondary winding 224-2) the right outer leg 236. In some embodiments, the pulse transformer 220 occupies a very small fraction of the window area of the integrated magnetic circuit element so that the impact on the efficiency of the power magnetic circuit element is minimized.

The side of the primary winding 222-1 on the left outer leg 234 is connected in series with the side of the primary winding 222-2 on the right outer leg 236. Similarly, the side of the secondary winding 224-1 on the left outer leg 234 is connected in series with the side of the secondary winding 224-2 on the right outer leg 236. The two sides of the secondary winding 224-1 and 224-2 have the same number of turns, and the two sides of the primary winding 222-1 and 222-2 have the same number of turns. The two outer legs (234 and 236) have substantially the same cross-sectional area. In some embodiments, the cross-sectional area of the center post 232 is substantially equal to the sum of the cross-sectional areas of the outer legs 234 and 236. In this way, it may be possible to maintain the substantially same flux density in all three legs 232, 234, and 236, even when the center post 232 has twice the amount of flux.

The two primary windings 222-1 and 222-2 have their polarities arranged so that a current in the side of the primary winding 222-1 on the left outer leg 234 that produces an upwards flux in the left outer leg 234 produces a substantially equal downward flux in the right outer leg 236. The two secondary windings 224-1 and 224-2 have their polarities arranged so that a current in the side of the secondary winding 224-1 on the left outer leg 234 that produces an upwards flux in the left outer leg 234 produces an equal downward flux in the right outer leg 236. It will be appreciated that windings may include different numbers of turns or may be formed in different directions without departing from the scope of the embodiments. These and other variations may be desirable for various types of applications.

Figure 3:
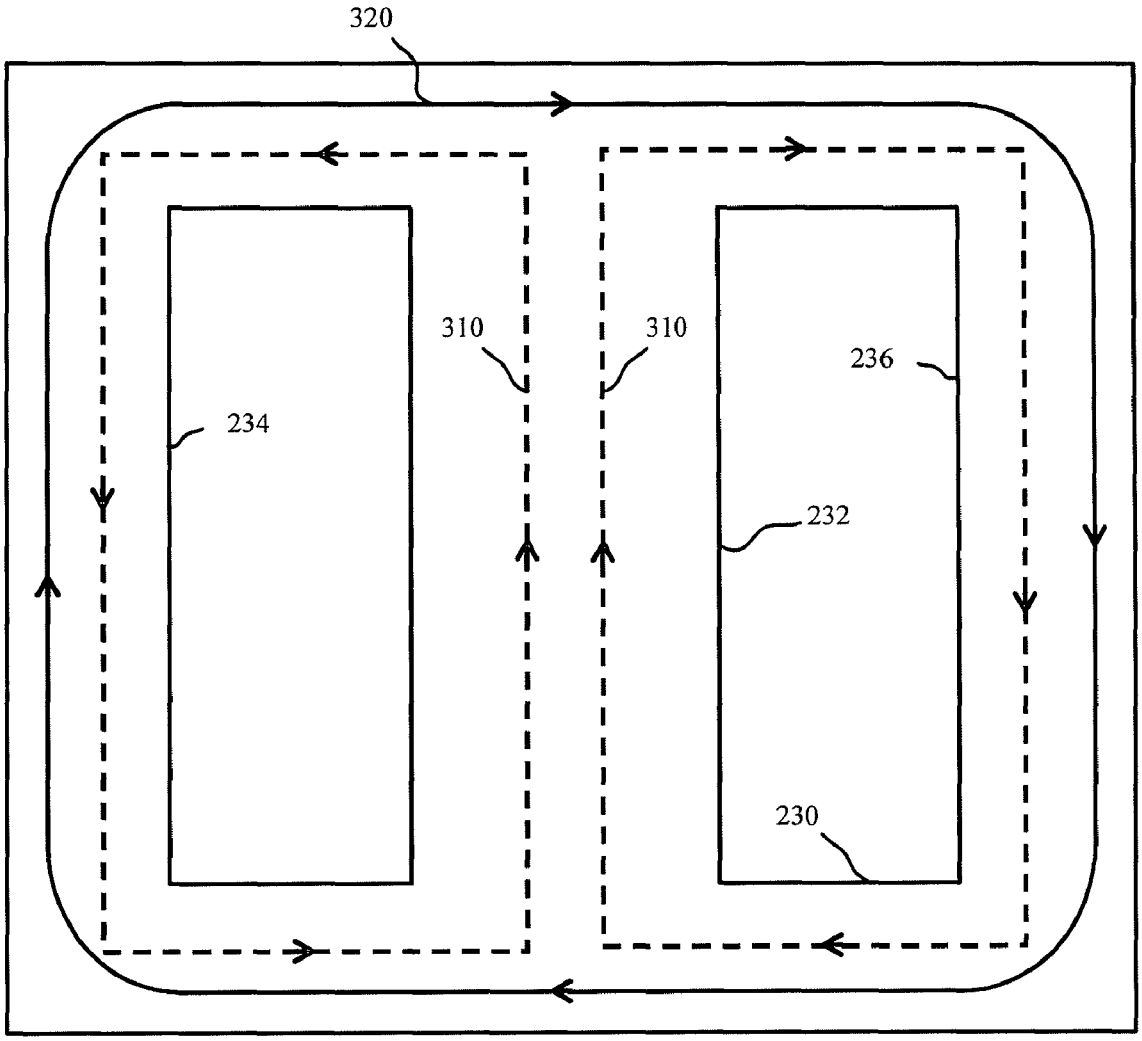
FIG. 3 shows an illustration of exemplary magnetic flux paths corresponding to the operation of an integrated multi-transformer like the one shown in FIG. 2, according to embodiments of the invention.

FIG. 3 shows an illustration of exemplary magnetic flux paths corresponding to the operation of an integrated multi-transformer like the one shown in FIG. 2, according to embodiments of the invention. The power element flux 310 (e.g., the magnetic flux generated by the operation of the power transformer 210 in FIG. 2) circles from the center post 232 of the core 230 around each of the outer legs 234 and 236 in opposite directions, as shown.

In one embodiment, the power transformer (e.g., FIG. 2, element 210) is wound such that the power element flux 310 flows up the center post 232 and down each of the outer legs (234 and 236). The power element flux 310 produced by the currents in the windings 212 and 214 of the power transformer 210 wound on the center post 232 produces substantially equal flux in both outer legs 234 and 236. The power element flux 310 produced by the windings 212 and 214 wound on the center post 232 may divide substantially equally between the two outer legs 234 and 236, so that both the magnitude of the power element flux 310 and its direction may be the same in the two outer legs 234 and 236.

The power element flux 310 may induce a voltage in both sides of the primary winding 222-1 and 222-2 of the pulse transformer 220. The voltage induced in the primary winding 222-1 wound on the left outer leg 232 may be equal and opposite to the voltage induced in the primary winding 222-2 wound on the right outer leg 234, so that the net voltage induced in the series connection of the primary winding 222-1 wound on the left outer leg 232 and the primary winding 222-2 wound on the right outer leg 234 may essentially be zero. The primary winding 222 of the pulse transformer 220 may operate substantially as if uncoupled from and independent of the primary winding 212 and the secondary winding 214 of the power transformer 210 wound on the center post 232.

Similarly, the power element flux 310 may induce a voltage in both sides of the secondary winding 224-1 and 224-2 of the pulse transformer 220. The voltage induced in the secondary winding 224-1 wound on the left outer leg 232 may be equal and opposite to the voltage induced in the secondary winding 224-2 wound on the right outer leg 234, so that the net voltage induced in the series connection of the secondary winding 224-1 wound on the left outer leg 232 and the secondary winding 224-2 wound on the right outer leg 234 may essentially be zero. The secondary winding 222 of the pulse transformer 220 may operate substantially as if uncoupled from and independent of the primary winding 212 and the secondary winding 214 of the power transformer 210 wound on the center post 232.

Of course, operation of the pulse transformer 220 may produce a pulse element flux 320. Where the primary winding 222 and the secondary winding 224 of the pulse transformer 220 are wound as shown in FIG. 2, the pulse element flux 320 may flow in the direction shown in FIG. 3. As illustrated, the pulse element flux 320 flows around the periphery of the core 230, e.g., up the left outer leg 232 and down the right outer leg 234.

It will now be appreciated that, among other things, this exemplary configuration provides tight coupling between the windings of each transformer, while minimizing coupling with windings of the other transformer. The primary winding 222 of the pulse transformer 220 wound on the outer legs 234 and 236 may be tightly coupled magnetically to the secondary winding 224 of the pulse transformer 220 wound on the outer legs 234 and 236. Similarly, the primary winding 212 of the power transformer 210 wound on the center post 232 may be tightly coupled magnetically to the secondary winding 214 of the power transformer 210 wound on the center post 232. At the same time, both the primary winding 222 and the secondary winding 224 of the pulse transformer 220 may be uncoupled from and independent of both the primary winding 212 and the secondary winding 214 of the power transformer 210 coupled to the center post 232.

Figure 4A:
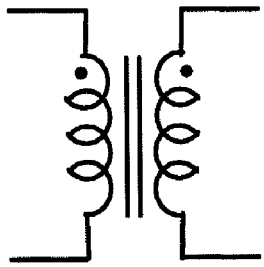
FIGS. 4A and 4B show illustrative equivalent electrical circuits of embodiments of integrated multi-transformers, like those shown in FIGS. 2 and 3.
Figure 4B:
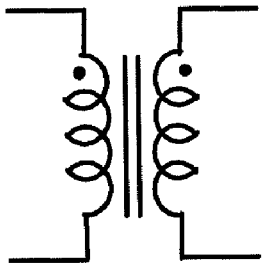

FIGS. 4A and 4B show illustrative equivalent electrical circuits of embodiments of integrated multi-transformers, like those shown in FIGS. 2 and 3. FIG. 4A shows an illustrative equivalent electrical circuit of a power transformer, based on the power element flux 310 paths through the center post 232 and the outer legs 234 and 236, as shown in FIG. 3. FIG. 4B shows an illustrative equivalent electrical circuit of a pulse transformer, based on the pulse element flux 320 paths around the outer legs 234 and 236, as shown in FIG. 3. FIGS. 4A and 4B illustrate that the transformers operate substantially equivalently to a configuration with two separate and isolated transformers.

Figure 5:
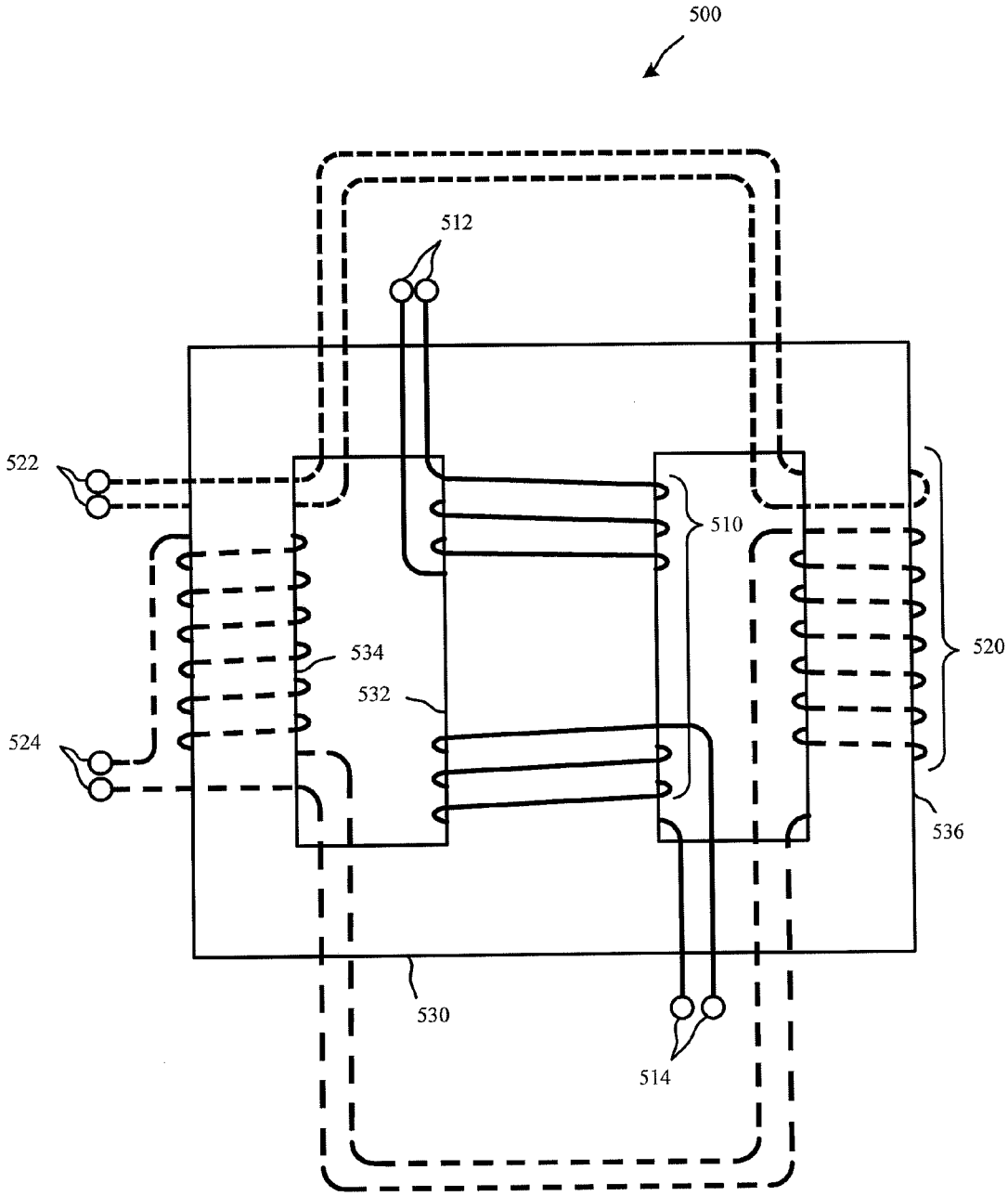
FIG. 5 shows another embodiment of an exemplary integrated multi-transformer, according to embodiments of the invention.

FIG. 5 shows another embodiment of an exemplary integrated multi-transformer, according to embodiments of the invention. The integrated multi-transformer 500 includes a power transformer 510 with a primary winding 512 and a secondary winding 514, and a current sense transformer 520 with a primary winding 522 and a secondary winding 524. The power transformer 510 and the current sense transformer 520 are integrated on a single core 530, such that the transformers are decoupled.

In some embodiments, power transformer 510 and the current sense transformer 520 are integrated on a three-leg "E" core 530, similar to the "E" core 230 shown in FIG. 2. The power transformer 510 may be wound on and coupled to a center post 532 of the core 530 and the current sense transformer 520 may be wound on the outer legs 534 and 536 of the core 532. The transformer windings may be configured, so that currents in one transformer induce zero net voltage into the windings of the other transformer.

Figure 6A:
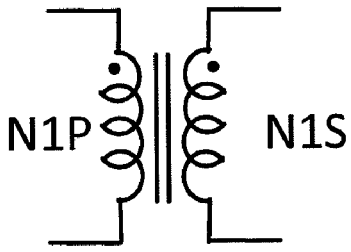
FIGS. 6A and 6B show illustrative equivalent electrical circuits of an embodiment of an integrated multi-transformer, like the one shown in FIG. 5.
Figure 6B:
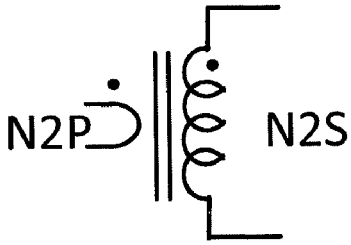

FIGS. 6A and 6B show illustrative equivalent electrical circuits of an embodiment of an integrated multi-transformer, like the one shown in FIG. 5. The equivalent electrical circuits of FIGS. 6A and 6B illustrate that the transformers may operate substantially equivalently to a configuration with two separate and isolated transformers.

It will be appreciated that there are many ways to further expand capabilities of integrated multi-transformers, according to various embodiments. One set of expanded capabilities derives from extending the functionality of the individual transformers. In some embodiments, signals passing through a pulse transformer are modulated in one or more ways. Many different types of modulation systems may be used. For example, analog information may be transmitted across an isolation boundary using a small signal pulse transformer and frequency modulation, pulse width modulation, delta modulation, or some other analog modulation technique. Digital information may also be transmitted using the same, similar, or different modulation techniques. In one embodiment, different modulation techniques are combined to transmit multiple signals across an isolation boundary using a single pulse transformer. For example, in a power supply, a relatively slow moving error voltage may be transmitted using pulse width modulation. At the same time, a fast discrete (or digital) signal having four levels indicating heavy load, medium load, light load, or standby load statuses may be transmitted using frequency modulation over the same small signal pulse transformer.

Figure 7:
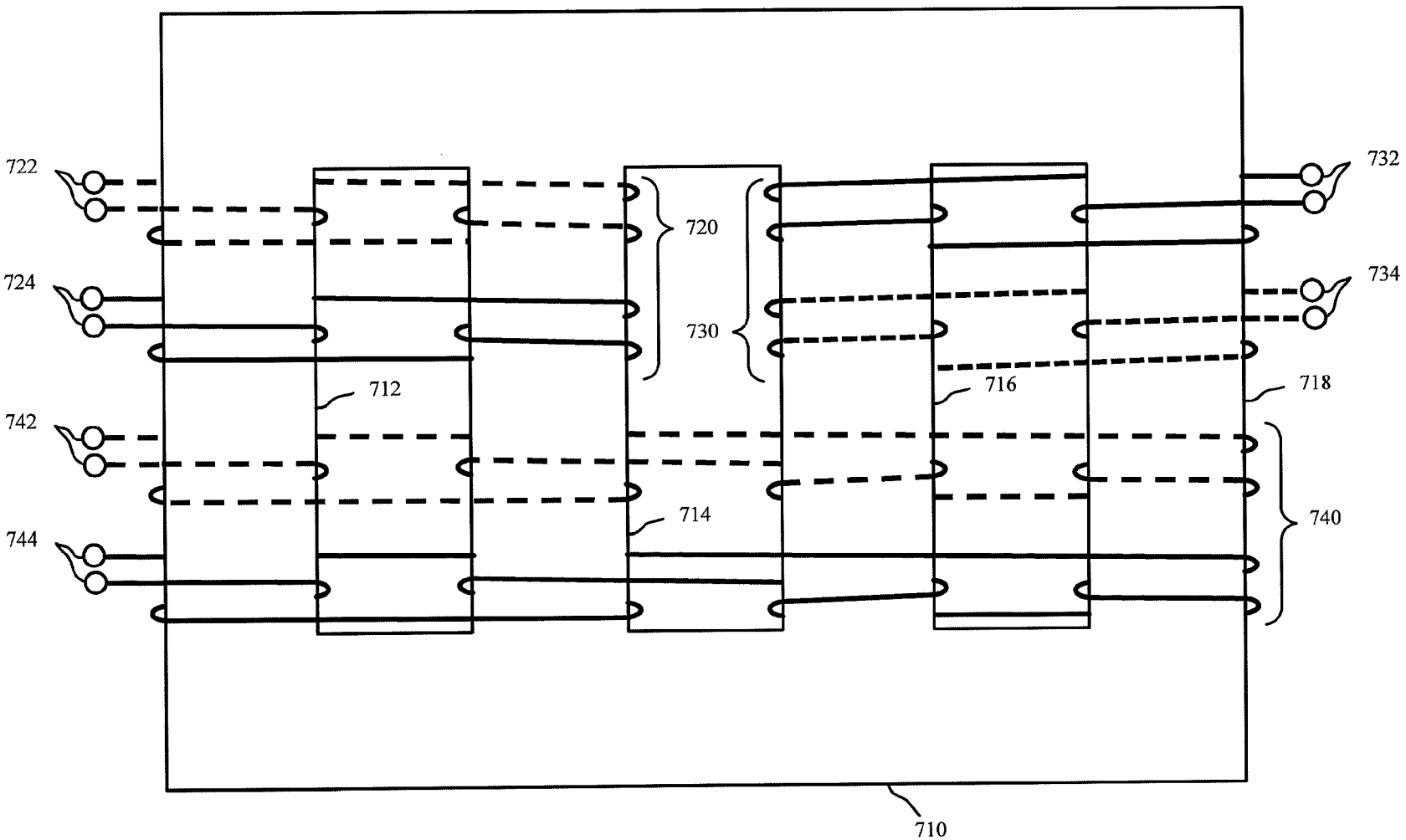
FIG. 7 shows an integrated multi-transformer having three independent transformers integrated onto a single core.

Another set of expanded capabilities derives from using other types and numbers of windings, other cores, and other physical configuration options. FIG. 7 shows an integrated multi-transformer having three independent transformers integrated onto a single core. The core 710 has four substantially identical legs 712, 714, 716, and 718. A first transformer 720 has a primary winding 722 and a secondary winding 724, both of which are wound on the first leg 712 and the second leg 714 of the core 710. A second transformer 730 has a primary winding 732 and a secondary winding 734, both of which are wound on the third leg 716 and the fourth leg 718 of the core 710. A third transformer 740 has a primary winding 742 and a secondary winding 744, both of which are wound on all four legs 712, 714, 716, and 718 of the core 710.

Figure 8A:
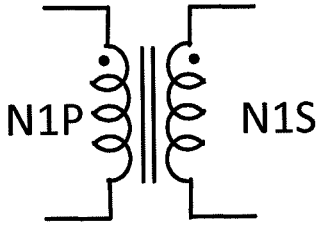
FIGS. 8A-8C show illustrative equivalent electrical circuits of an embodiment of an integrated multi-transformers, like the one shown in FIG. 7.
Figure 8B:
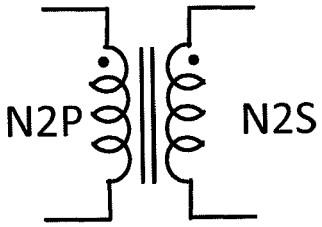
Figure 8C:
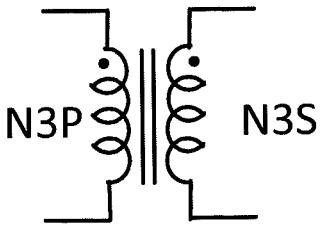

FIGS. 8A-8C show illustrative equivalent electrical circuits of an embodiment of an integrated multi-transformer, like the one shown in FIG. 7. In this illustrative case, the flux path represented by each of the four legs 712, 714, 716, and 718 may have substantially identical magnetic reluctance to the other legs 712, 714, 716, and 718. For each transformer, the net voltage induced in the transformer due to currents in either one of the other transformers is substantially zero. As such, the equivalent circuits in FIGS. 8A-8C illustrate that the transformers may operate substantially equivalently to a configuration with three separate and isolated transformers.

Figure 9A:
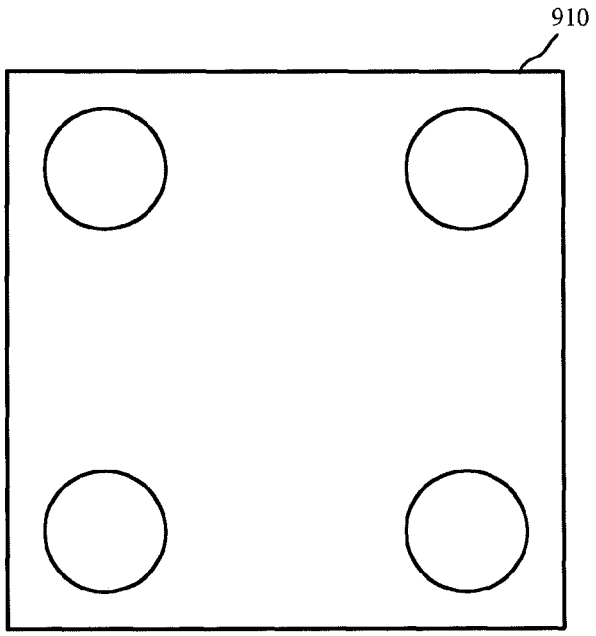
FIG. 9 illustrates an embodiment of a physical core structure for a core having four flux paths with identical magnetic reluctances, according to various embodiments.
Figure 9B:
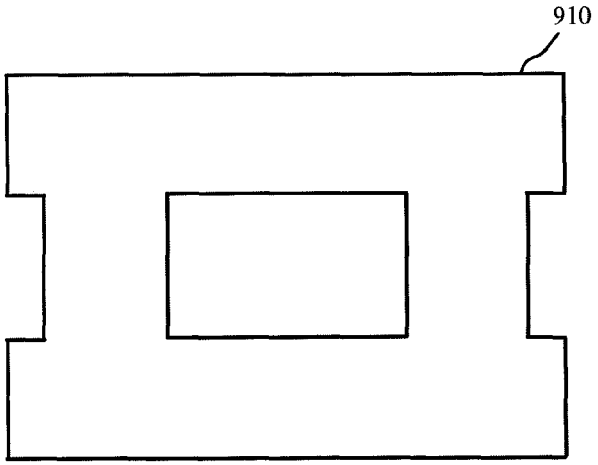

FIGS. 9A and 9B illustrate an embodiment of a physical core structure for a core having four flux paths with identical magnetic reluctances, according to various embodiments. In some embodiments, the core 910 may be used to produce three independent, integrated transformers with closed magnetic flux paths. In one embodiment, the windings are formed similarly to those in FIG. 7. For each integrated transformer, the net voltage induced in the integrated transformer due to currents in either one of the other integrated transformers may be zero. In this way, each integrated transformer may be able to operate without being affected by the induced voltages from the other integrated transformers coupled to the same core.

The embodiments discussed above show that, in general, N−1 independent transformers with closed magnetic flux paths may be created using a single core having N legs. In fact, more than N−1 independent transformers may be created in some cases, depending on the shape of the core, by wiring the additional transformers in planes that are orthogonal to the windings of the integrated multi-transformer. For example, using the integrated multi-transformer of FIG. 9, a transformer may be wound "horizontally" around the periphery of the core 910 (i.e., in the plane of the drawing), and another transformer may be wound "vertically" around the periphery of the core 910. This configuration may provide up to five independent transformers on a single core. It is worth noting, however, that, while the additional orthogonal windings may be used as transformers or other magnetic elements, the operation of those windings may not generate closed magnetic flux paths in the core. As such, the generated orthogonal magnetic fields may be more susceptible to external noise.

Figure 10A:
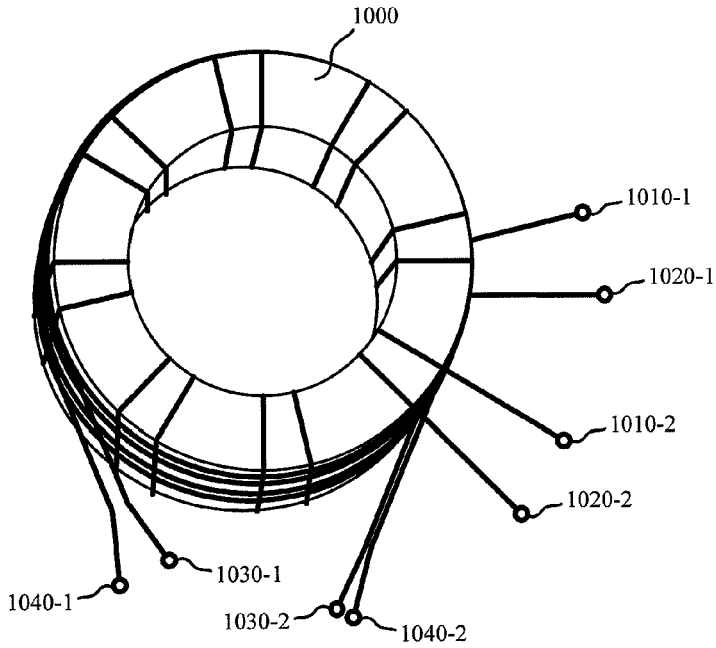
FIG. 10A-10C illustrate embodiments of multi-transformers using a circular core on which are formed multiple transformers, according to various embodiments.
Figure 10B:
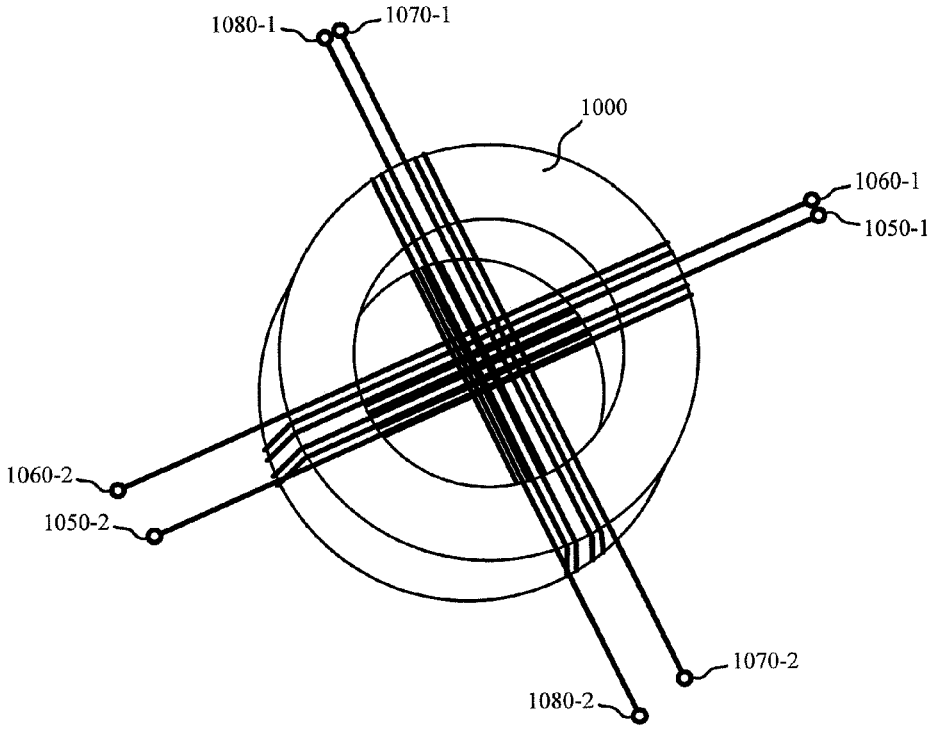
Figure 10C:
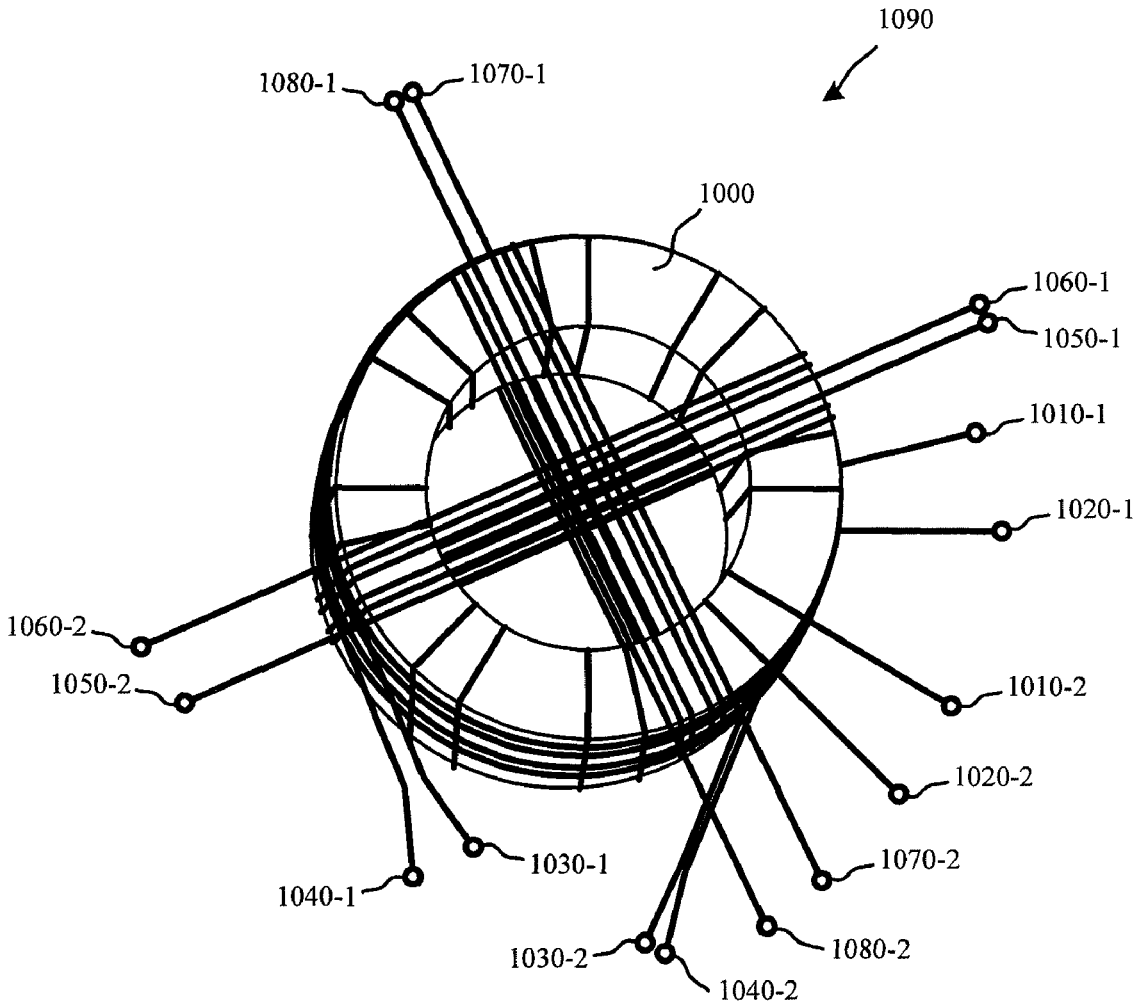

FIG. 10A-10C illustrate embodiments of multi-transformers using a circular core on which are formed multiple transformers, according to various embodiments. In the embodiment shown in FIG. 10A, a first transformer, having its respective primary winding 1010 and secondary winding 1020, is wound toroidally around the circular core 1000. A second transformer, having its respective primary winding 1030 and secondary winding 1040, is wound around the equator of the circular core 1000. It will be appreciated that each of the first and second transformers generates a flux in the circular core 1000 that is substantially orthogonal to the other flux. As such, the flux generated from the first transformer's primary winding 1010 will induce substantially no current in the second transformer's secondary winding 1040, and the flux generated from the second transformer's primary winding 1030 will induce substantially no current in the first transformer's secondary winding 1020.

In the embodiment shown in FIG. 10B, a first transformer, having its respective primary winding 1050 and secondary winding 1060, is wound across a diameter of the circular core 1000. A second transformer, having its respective primary winding 1070 and secondary winding 1080, is wound around a second diameter of the circular core 1005, the second diameter being perpendicular to the first. As in FIG. 10A, it will be appreciated that each of the first and second transformers generates a flux in the circular core 1000 that is substantially orthogonal to the other flux. As such, the flux generated from the first transformer's primary winding 1050 will induce substantially no current in the second transformer's secondary winding 1080, and the flux generated from the second transformer's primary winding 1070 will induce substantially no current in the first transformer's secondary winding 1060.

FIG. 10C shows an embodiment of a multi-transformer 1090 having four transformers wound on the same circular core 1000, essentially combining the embodiments shown in FIGS. 10A and 10B. The first transformer, having its respective primary winding 1010 and secondary winding 1020, is wound toroidally around the circular core 1000. The second transformer, having its respective primary winding 1030 and secondary winding 1040, is wound around the equator of the circular core 1000. The third transformer, having its respective primary winding 1050 and secondary winding 1060, is wound across a diameter of the circular core 1000. The fourth transformer, having its respective primary winding 1070 and secondary winding 1080, is wound around a second diameter of the circular core 1005, the second diameter being perpendicular to the first.

As discussed above, each of the first and second transformers generates a flux in the circular core 1000 that is substantially orthogonal to the fluxes generated by the other transformers in the multi-transformer 1090. For example, the flux generated from the first transformer's primary winding 1010 will induce substantially no current in the second transformer's secondary winding 1040, third transformer's secondary winding 1060, or forth transformer's secondary winding 1080. Still, however, each primary winding (e.g., the first transformer's primary winding 1010) remains tightly magnetically coupled through the circular core 1000 with its respective secondary winding (the first transformer's secondary winding 1020).

Figure 11:
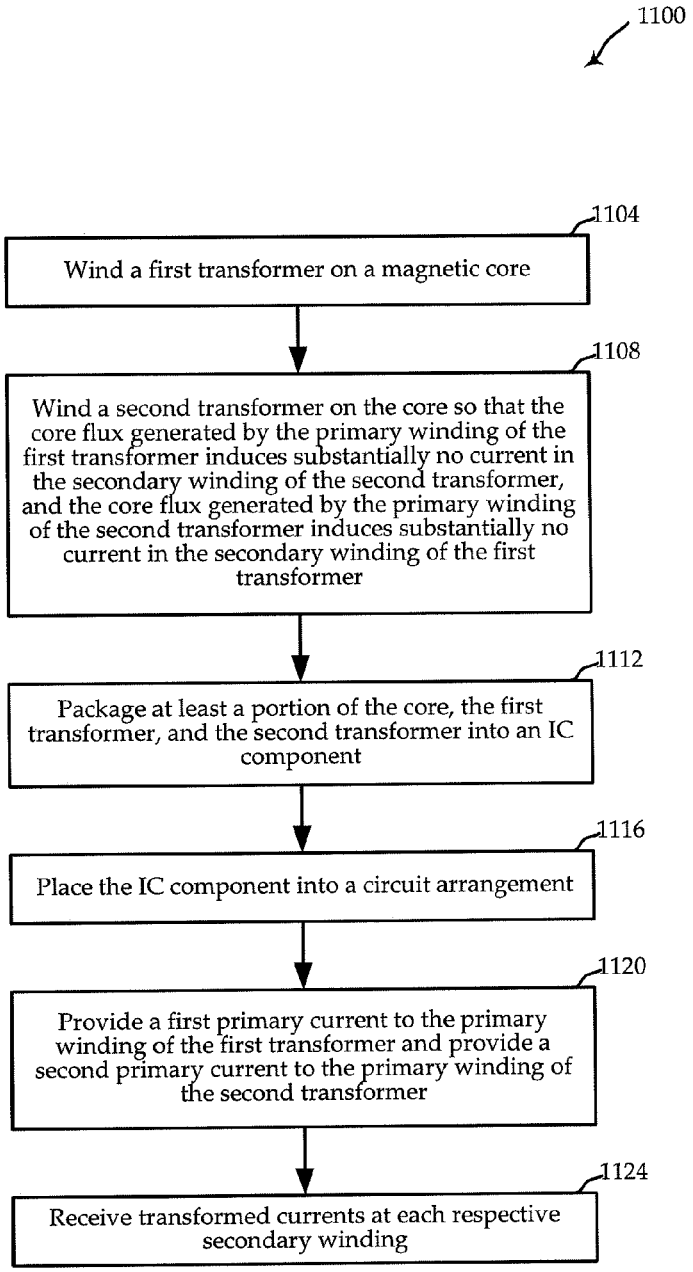
FIG. 11 shows a flow diagram of exemplary methods for providing an integrated multi-transformer, according to embodiments of the invention.

FIG. 11 shows a flow diagram of exemplary methods for providing an integrated multi-transformer, according to embodiments of the invention. The method 1100 begins by winding a first transformer on a core made of a magnetic material at block 1104. The first transformer has a primary winding and a secondary winding. The primary winding is configured to receive a first primary current and to couple the first primary current to the core to generate a first core flux. At block 1108, a second transformer is wound on the core. The second transformer also has a primary winding and a secondary winding. The primary winding is configured to receive a second primary current and to couple the second primary current to the core to generate a second core flux.

In each transformer, the secondary winding is configured so that at least a portion of its generated core flux is coupled from the core to induce a respective secondary current in its respective secondary winding. Notably, the second transformer is wound on the core so that the first core flux induces substantially no current in the secondary winding of the second transformer, and the second core flux induces substantially no current in the secondary winding of the first transformer. In some embodiments, this includes winding the first transformer in a first plane, and winding the second transformer in a second plane, with the second plane being substantially orthogonal to the first plane.

In some embodiments, the method 1100 further includes packaging at least a portion of the core, the first transformer, and the second transformer into an integrated circuit component at block 1112. The integrated circuit component may then be placed into a circuit arrangement at block 1116. In other embodiments, the method 1100 includes providing the first primary current to the primary winding of the first transformer and providing the second primary current to the primary winding of the second transformer at block 1120. A transformed current may then be received at each respective secondary winding at block 1024.

It should be noted that the methods, systems, and devices discussed above are intended merely to be examples. It must be stressed that various embodiments may omit, substitute, or add various procedures or components as appropriate. As one example, embodiments are illustrated and/or described as having transformers with particular types or shapes of cores, or particular numbers, shapes, and directions of turns. However, it will be appreciated that these illustrative embodiments are not intended to limit the scope of the invention in any way, and that different transformer attributes may be desirable for different applications.

Further, it should be appreciated that, in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

It should also be appreciated that the following systems, methods, and software may individually or collectively be components of a larger system, wherein other procedures may take precedence over or otherwise modify their application. Also, a number of steps may be required before, after, or concurrently with the following embodiments.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered.

Accordingly, the above description should not be taken as limiting the scope of the invention, as described in the following claims.

What is claimed is:

1. An integrated multi-transformer, comprising:

a core made of magnetic material;

a plurality of transformers magnetically coupled with the core, including:

a pulse transformer comprising a first primary winding and a first secondary winding, the first primary winding being configured to receive a first primary current and to couple the first primary current to the core to generate a first core flux, and the first secondary winding being configured so that at least a portion of the first core flux is coupled from the core to induce a first secondary current in the first secondary winding; and a power transformer comprising a second primary winding and a second secondary winding, the second primary winding being configured to receive a second primary current and to couple the second primary current to the core to generate a second core flux, and the second secondary winding being configured so that at least a portion of the second core flux is coupled from the core to induce a second secondary current in the second secondary winding, wherein the first core flux induces substantially no current in the power transformer and the second core flux induces substantially no current in the pulse transformer.

2. The integrated multi-transformer of claim 1, wherein:

the core is an "E" core, comprising a first leg, a second leg, and a third leg, wherein the first leg and the third leg have substantially equivalent cross-sectional areas;

the first primary winding is wound on the first leg and the third leg;

the first secondary winding is wound on the first leg and the third leg; and the second primary winding and the second secondary winding are wound on the second leg.

3. The integrated multi-transformer of claim 2, wherein, the second leg has substantially double the cross-sectional area of the first leg.

4. The integrated multi-transformer of claim 1, wherein the core comprises a number of legs, the number of legs being one greater than the number of transformers coupled with the core.

5. The integrated multi-transformer of claim 1, wherein the power transformer is wound substantially orthogonally with respect to the pulse transformer.

6. The integrated multi-transformer of claim 5, wherein the plurality of transformers further includes:

an additional transformer wound on the core substantially orthogonally with respect to the pulse transformer.

7. The integrated multi-transformer of claim 1, wherein the plurality of transformers further includes:

an additional transformer wound on the core substantially orthogonally with respect to at least one of the pulse transformer or the power transformer.

8. The integrated multi-transformer of claim 7, wherein:

the additional transformer is selected from the group consisting of: a power transformer, a pulse transformer, a signal transformer, and a current sense transformer.

9. The integrated multi-transformer of claim 1, wherein:

the pulse transformer is wound substantially orthogonally with respect to the power transformer; and the plurality of transformers further includes an additional transformer wound on the core substantially orthogonally with respect to both the pulse transformer or the power transformer.

10. The integrated multi-transformer of claim 1, wherein at least a portion of the core is circular and the pulse transformer is formed toroidally around the core.

11. The integrated multi-transformer of claim 1, further comprising:

packaging configured to be placed in a circuit arrangement and to house at least a portion of the core and the plurality of transformers magnetically coupled with the core.

12. The integrated multi-transformer of claim 11, wherein the packaging is further configured to provide at least partial physical, electrical, or electromagnetic isolation.

13. The integrated multi-transformer of claim 11, wherein the packaging comprises a plurality of interface regions, including:

a first interface region coupled with the first primary winding;

a second interface region coupled with the first secondary winding;

a third interface region coupled with the second primary winding; and a fourth interface region coupled with the second secondary winding.

14. The integrated multi-transformer of claim 11, wherein the packaging comprises a core interface region coupled with the core.

15. A system for handling multiple signals using an integrated multi-transformer, the system comprising:

a first signal generation module configured to generate a first generated signal;

a second signal generation module configured to generate a second generated signal;

a first signal utilization module configured to utilize a first transformed signal;

a second signal utilization module configured to utilize a second transformed signal; and a multi-transformer, comprising core, a pulse transformer, and a power transformer, the pulse transformer being wound on the core and configured to generate a first magnetic flux in the core, and the power transformer being wound on the core and configured to generate a second magnetic flux in the core, the second magnetic flux being decoupled from the first magnetic flux, wherein the pulse transformer is configured to receive the first generated signal from the first signal generation module, generate the first transformed signal as a function of the first generated signal, and communicate the first transformed signal with the first signal utilization module, and wherein the power transformer is configured to receive the second generated signal from the second signal generation module, generate the second transformed signal as a function of the second generated signal, and communicate the second transformed signal with the second signal utilization module.

16. The system of claim 15, wherein:

the first signal generation module comprises a sensor arrangement configured to receive a sensory input and to generate the first generated signal as a function of the sensory input.

17. The system of claim 16, wherein the first signal utilization module comprises a decoder arrangement configured to receive the first transformed signal and to derive information relating to the sensory input as a function of the first transformed signal, and wherein the first transformer is further configured to electrically isolate the decoder arrangement from the sensor arrangement.

18. A method for producing an integrated multi-transformer device, the method comprising:

winding a pulse transformer on a core made of a magnetic material, the pulse transformer comprising a first primary winding and a first secondary winding, the first primary winding being configured to receive a first primary current and to couple the first primary current to the core to generate a first core flux, and the first secondary winding being configured so that at least a portion of the first core flux is coupled from the core to induce a first secondary current in the first secondary winding; and winding a power transformer on the core, the power transformer comprising a second primary winding and a second secondary winding, the second primary winding being configured to receive a second primary current and to couple the second primary current to the core to generate a second core flux, and the second secondary winding being configured so that at least a portion of the second core flux is coupled from the core to induce a second secondary current in the second secondary winding, wherein the power transformer is wound on the core so that the first core flux induces substantially no current in the second secondary winding and the second core flux induces substantially no current in the first secondary winding.

19. The method of claim 18, wherein winding the pulse transformer on the core comprises winding the first primary winding and the first secondary winding in a first plane, and wherein winding the power transformer on the core comprises winding the second primary winding and the second secondary winding in a second plane, the second plane being substantially orthogonal to the first plane.

20. The method of claim 18, further comprising:

packaging at least a portion of the core, the pulse transformer, and the power transformer into an integrated circuit component; and placing the integrated circuit component into a circuit arrangement.

21. The method of claim 18, further comprising:

providing the first primary current to the first primary winding of the first transformer;

providing the second primary current to the second primary winding of the second transformer, wherein a portion of the second primary current is provided substantially contemporaneously with a portion of the first primary current.

* * * * *